United States Patent [19]

Oberg

[11] 4,185,220

[45] Jan. 22, 1980

[54] CATHODE RAY DISPLAY TUBE WITH CONTRAST ENHANCEMENT PANEL

[75] Inventor: Albert E. Oberg, Veteran, N.Y.

[73] Assignee: Westinghouse Electric Corp., Pittsburgh, Pa.

[21] Appl. No.: 811,746

[22] Filed: Jun. 30, 1977

[51] Int. Cl.[2] ..... H01J 29/89

[52] U.S. Cl. ..... 313/478; 358/252

[58] Field of Search ..... 313/478, 477, 474; 258/250, 252

[56] References Cited

U.S. PATENT DOCUMENTS

| | | | |
|---|---|---|---|
| 2,172,775 | 9/1939 | Schmidt-Ott et al. | 313/474 X |
| 2,312,206 | 2/1943 | Calbick | 313/474 |
| 2,531,956 | 11/1950 | Waldorf et al. | 358/250 X |
| 2,958,801 | 11/1960 | Herriott | 313/478 |
| 3,048,729 | 8/1962 | Perry | 313/478 |
| 3,504,212 | 3/1970 | Wollentin et al. | 313/474 |
| 3,697,154 | 10/1972 | Johnson | 358/250 X |
| 3,760,215 | 9/1973 | Sach | 313/474 |

FOREIGN PATENT DOCUMENTS

| | | | |
|---|---|---|---|
| 481445 | 3/1938 | United Kingdom | 313/477 |

*Primary Examiner*—Robert Segal

*Attorney, Agent, or Firm*—W. G. Sutcliff

[57] ABSTRACT

A cathode ray display tube is provided with a contrast enhancement panel which is optically coupled to the tube faceplate. The contrast enhancement panel has a viewing surface which is spherical and concave with respect to a viewer.

2 Claims, 2 Drawing Figures

CATHODE RAY DISPLAY TUBE WITH CONTRAST ENHANCEMENT PANEL

BACKGROUND OF THE INVENTION

The present invention relates to the field of cathode ray display tubes, such as are used in high ambient lighting areas, such as for aircraft cockpit displays. In such applications it is critical to optimize the display contrast by minimizing glare and light reflections which impair the viewer's readability.

It has long been the practice to use clear glass and increase the signal brightness to higher luminance levels than the reflected light. More recently it has become the practice to use low light transmissivity faceplate glass in such tubes to reduce the reflection of exterior light from the interior surface of the faceplate, and from the phosphor disposed on the faceplate interior surface. Incident light is effectively absorbed by the low light transmissivity faceplate glass. Anti-reflective coatings have also been used on the faceplate exterior surface to reduce reflected incident light which lowers contrast. Circular polarizers have also been used with the tube faceplate to reduce specular reflections from the faceplate interior surface.

The conventional cathode ray display tube typically has an exterior surface which is planar or convex with respect to the viewer. With a planar or convex faceplate, objects in front of the faceplate which emit or reflect light cause specular reflections which can result in disturbing glare for the viewer and loss of contrast for the display.

In the typical high ambient light level applications, such as aircraft cockpit use, the viewer is typically in a fixed position relatively close to the tube faceplate.

SUMMARY OF THE INVENTION

A cathode ray display tube is provided with a contrast enhancement panel optically coupled to the tube faceplate. The contrast enhancement panel has a viewing surface which is spherical and concave with respect to a viewer. The radius of curvature of the panel spherical concave surface is made approximately equal to a predetermined viewer distance.

DESCRIPTION OF THE PREFERRED EMBODIMENT

Figure 1:
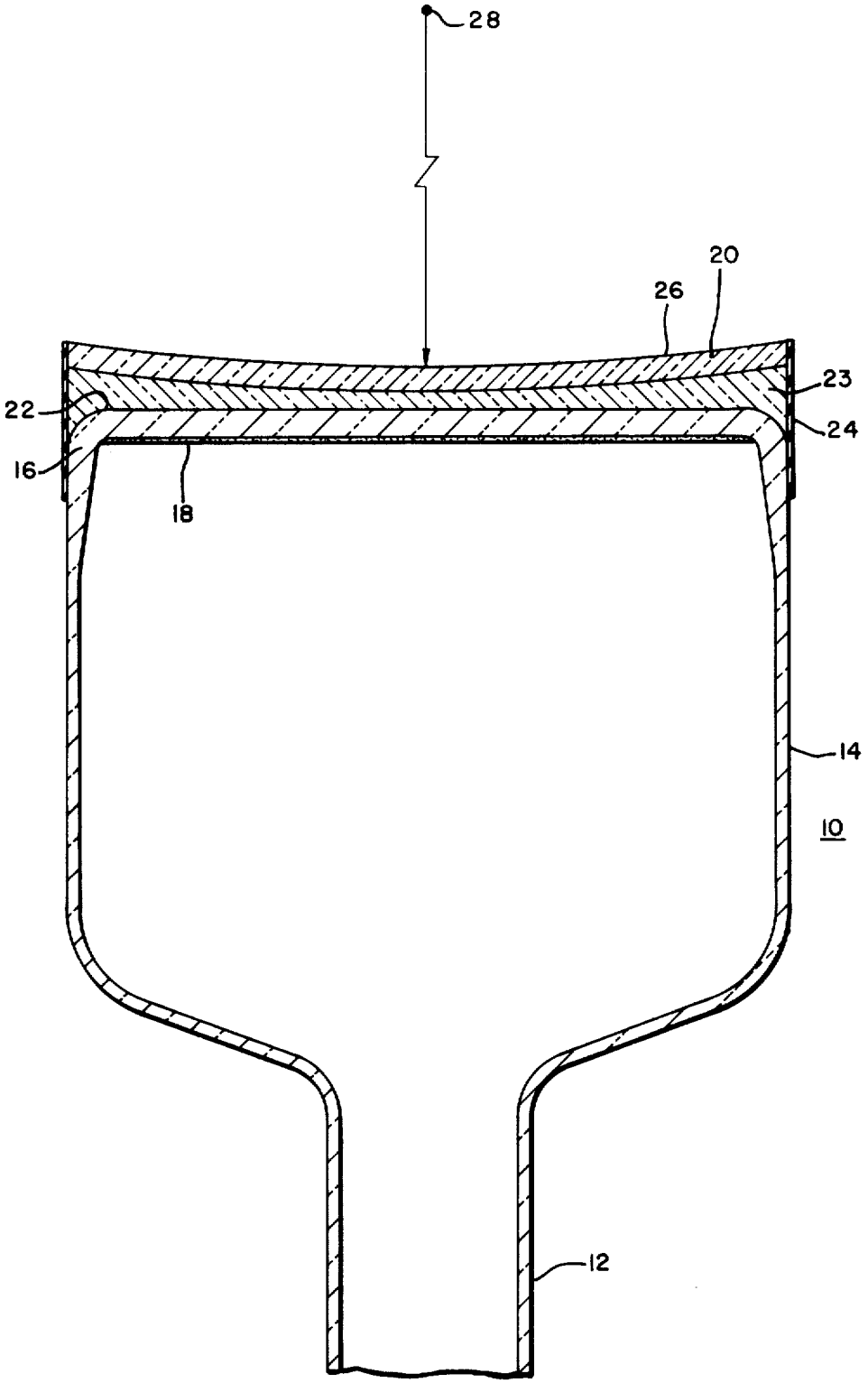
FIG. 1 is a side elevational view partly in section of an exemplary embodiment of the cathode ray display tube of the present invention.

A cathode ray display tube 10 includes a neck portion 12 within which is sealed an electron gun, not shown, a funnel portion 14, and a faceplate portion 16. A display phosphor layer 18 is provided on the interior surface of the faceplate portion 16. The phosphor layer is selectively made to luminesce by an electron beam from the electron gun, not shown, disposed in the neck portion to produce an information display.

A contrast enhancement panel 20 is optically coupled to the faceplate exterior surface 22 using a clear resin 23 which mates and optically couples the panel 20 to the faceplate exterior surface 22. In this embodiment the faceplate exterior surface 22 is planar. The exterior viewing surface 26 of the panel 20 has a spherical concave surface with respect to an external viewer.

In the embodiment shown, forming tape 24 is peripherally disposed about the faceplate perimeter. The tape 24 is used during assembly to hold the enhancement panel 20 in place spaced from the faceplate while the resin is poured in place between these members where it hardens to optically couple and structurally support the panel 20 from the faceplate 16.

The contrast enhancement panel 20 is most easily formed of a uniform thickness glass plate which is formed with the desired spherical cast to provide the spherical concave viewing surface 26. The glass panel is typically about 0.1875 inch thick. The hardened resin is thicker at the faceplate perimeter to mate with the spherical panel 20, with the resin being about 0.125 inch thick at the faceplate center and thicker at the faceplate perimeter.

A clear resin which can be used is styrene, vinyl toluene, or acrylate monomers, with a typical hardener being methyl ethyl keytone peroxide in dimethyl phthalate.

The external viewer is represented by point 28 and is a predetermined distance from the viewing surface 26. The radius of curvature of the spherical concave viewing surface 26 is made approximately equal to the viewer distance from the surface 26. By way of example, for a 5.25 inch diameter cathode ray display tube faceplate the radius of curvature of the spherical concave viewing surface was about twenty-two inches which corresponds to the spacing between an aircraft pilot viewer and the viewing surface in a particular application.

The contrast enhancement panel 20 is preferably low light transmissivity glass, and is preferably selected to make the overall transmission of the system about 10 to 15 percent. The clear resin 23 which mates and optically couples the panel to the tube faceplate is selected to have an index of refraction which closely matches that for the panel and the faceplate to eliminate any distortion or reflection.

Figure 2:
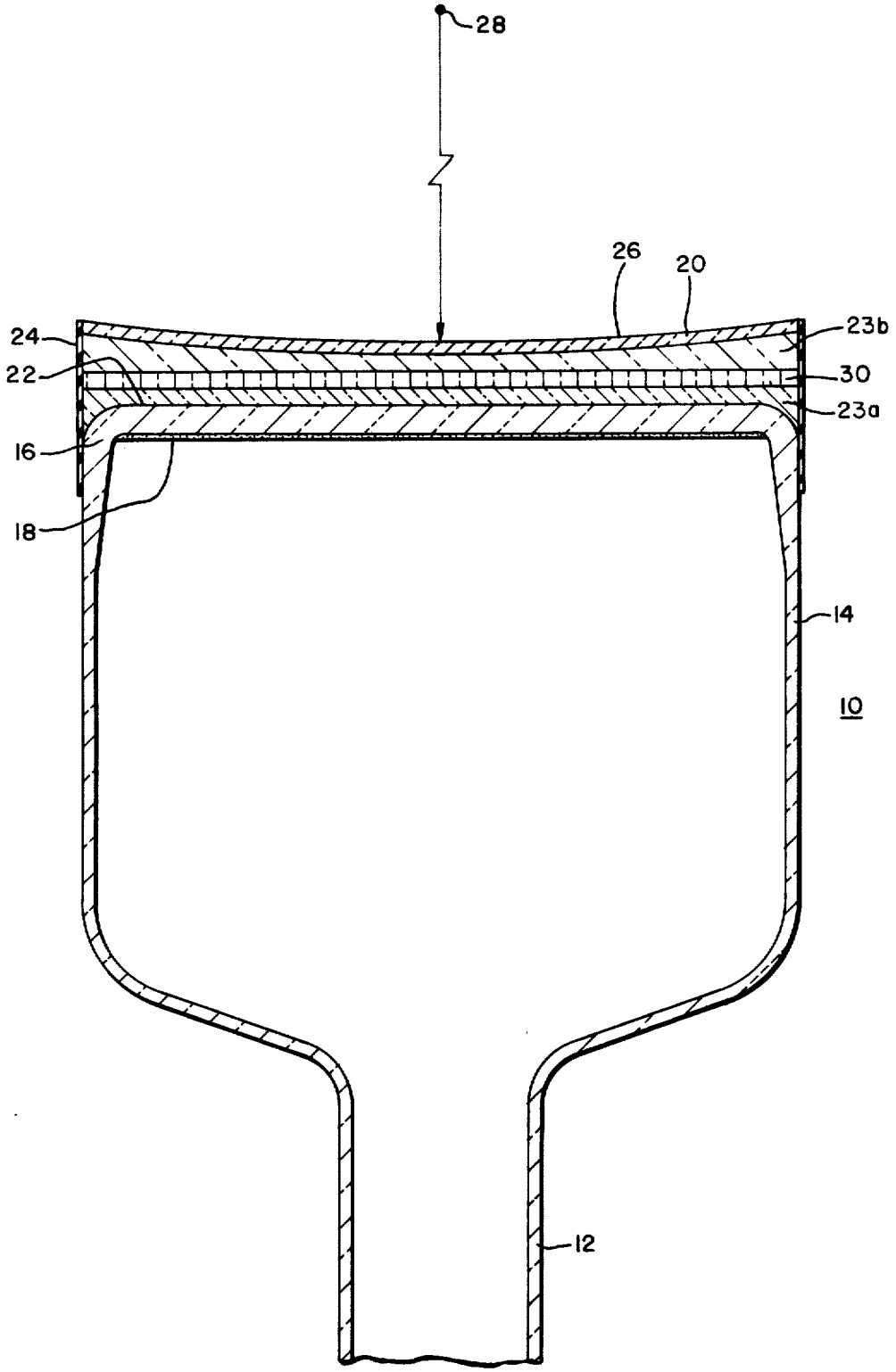
FIG. 2 is another embodiment of the present invention in which a circular polarizer is disposed between the tube faceplate and the contrast enhancement panel.

In the embodiment of FIG. 2, the display tube structure is the same as in FIG. 1, but a circular polarizer 30 is provided between the faceplate exterior surface 26 and the contrast enhancement panel 20 to further improve the contrast of the system by minimizing specular reflections from the inside surface of the table faceplate. When using a circular polarizer a higher transmissivity panel 20 should be employed, with the total system transmissivity being about 10–15 percent. A first clear resin layer **23*a* is provided between the faceplate and the circular polarizer, and a second clear resin layer 23*b* is provided between the circular polarizer 30 and the contrast enhancement panel 20**. An anti-reflective coating can also be applied to the spherical concave viewing surface of the panel to further optimize its contrast capability.

What is claimed is:

1. A cathode ray display tube having a display faceplate with a luminescent material disposed on the interior tube side of a light transmissive faceplate, the improvement wherein a limited light transmissive contrast enhancement panel is optically coupled to and mounted directly on a light transmissive clear resin layer disposed on the exterior surface of the faceplate, which resin layer closely matches the index of refraction of the faceplate, and which contrast enhancement panel has a viewing surface which is spherical and concave with respect to a viewer, with the radius of curvature of the spherical viewing surface approximately equal to a predetermined viewer distance, and wherein the overall light transmissivity of the faceplate, resin layer and contrast enhancement panel is about 10–15 percent.

2. The display tube set forth in claim 1, wherein the contrast enhancement panel has a relatively low light transmissivity, and a circular polarizer is provided between the cathode ray tube faceplate exterior surface and the contrast enhancement panel.

* * * * *